US011852048B2

(12) United States Patent
Pipis, Jr. et al.

(10) Patent No.: US 11,852,048 B2
(45) Date of Patent: Dec. 26, 2023

(54) GAS ADMISSION VALVE (GAV) ASSEMBLY AND SYSTEM AND METHOD THEREOF

(71) Applicant: Caterpillar Inc., Peoria, IL (US)

(72) Inventors: John Stephen Pipis, Jr., Washington, IL (US); Selvakumar Selvaraj, Chennai (IN); Eric Lee Schroeder, Germantown Hills, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/720,410

(22) Filed: Apr. 14, 2022

(65) Prior Publication Data

US 2023/0332519 A1 Oct. 19, 2023

(51) Int. Cl.

| | |
|---|---|
| ***F01L 1/18*** | (2006.01) |
| ***F01L 1/14*** | (2006.01) |
| *F02F 1/24* | (2006.01) |
| *F02F 1/42* | (2006.01) |

(52) U.S. Cl.

CPC ..... *F01L 1/181* (2013.01); *F01L 1/146* (2013.01); *F01L 2305/00* (2020.05); *F02F 1/4214* (2013.01); *F02F 2001/245* (2013.01)

(58) Field of Classification Search

USPC ..... 123/90.22, 90.4

See application file for complete search history.

(56) References Cited

U.S. PATENT DOCUMENTS

| | | | | |
|---|---|---|---|---|
| 1,965,466 | A * | 7/1934 | Moore | F01L 1/181 123/90.19 |
| 7,861,680 | B2 | 1/2011 | Diggs | |
| 8,851,045 | B2 | 10/2014 | Reitz et al. | |
| 9,546,612 | B2 | 1/2017 | Ge et al. | |
| 9,644,551 | B2 | 5/2017 | Marscheider et al. | |
| 10,968,789 | B2 | 4/2021 | Turuvekere Gurudatt et al. | |
| 2002/0179028 | A1* | 12/2002 | Sweetland | F01L 1/18 123/90.22 |
| 2004/0050361 | A1* | 3/2004 | Hannon | F01L 1/262 123/90.39 |
| 2016/0222841 | A1* | 8/2016 | Vorih | F01L 1/08 |
| 2017/0089223 | A1 | 3/2017 | Kizhakkethara et al. | |
| 2020/0347754 | A1 | 11/2020 | Chang et al. | |

FOREIGN PATENT DOCUMENTS

| | | | | |
|---|---|---|---|---|
| EP | 0433728 | A1 * | 6/1991 | F01L 1/26 |
| WO | WO-2020030299 | A1 * | 2/2020 | F01L 1/18 |
| WO | 2021/098983 | A1 | 5/2021 | |

* cited by examiner

*Primary Examiner* — Wesley G Harris

(74) *Attorney, Agent, or Firm* — Xsensus, LLP

(57) ABSTRACT

A valve bridge to operatively interface with a rocker arm and a valve, and systems, assemblies, and methods thereof can comprise: a body, of the valve bridge, having a first side and a second side opposite the first side, a first leg of the valve bridge extending from the first side of the body, a second leg of the valve bridge extending from the first side of the body, and a third leg of the valve bridge extending from the first side of the body. A first pin can extend from an end of the first leg opposite the body, and a second pin can extend from an end of the second leg opposite the body.

20 Claims, 5 Drawing Sheets

GAS ADMISSION VALVE (GAV) ASSEMBLY AND SYSTEM AND METHOD THEREOF

TECHNICAL FIELD

The present disclosure relates to valves for reciprocating engines, and more particularly to a valve bridge to operatively interface with a rocker arm and a valve, and systems, assemblies, and methods thereof.

BACKGROUND

It may be desirable to directly introduce a gas, such as hydrogen, into a cylinder of an engine. Actuation of a valve for such direct introduction of the gas may require independent timing control relative to intake and exhaust valve timing control. Furthermore, implementing such valve into an existing engine package may be challenging, for instance, due to the positioning of the direct introduction port for the gas.

U.S. Patent App. Pub. No. 2020/0347754 ("the '754 patent publication") describes a gas engine comprising a combustion cylinder having an intake with an intake valve and an exhaust with an exhaust valve. The '754 patent publication describes that a gas admission assembly with an electro-hydraulically actuatable gas admission valve may be implemented. However, the '754 patent publication describes that the electro-hydraulically actuatable gas admission valve controls a gas flow into the intake rather than the combustion cylinder.

SUMMARY

According to an aspect, a valve bridge is described and can be implemented or provided. The valve bridge can be to operatively interface with a rocker arm and a valve. The valve bridge can comprise: a body having a first side and a second side opposite the first side, a first leg extending from the first side of the body, a second leg extending from the first side of the body, and a third leg extending from the first side of the body. A first pin can extend from an end of the first leg opposite the body, and a second pin can extend from an end of the second leg opposite the body.

According to another aspect, an actuation assembly is described and can be implemented or provided. The actuation assembly can be to introduce hydrogen into a cylinder of a reciprocating engine. The actuation assembly can comprise: a rocker arm rotatably coupleable to a common shaft; and a valve bridge to operatively interface with a first end of the rocker arm. The valve bridge can include: a base having a first side and a second side opposite the first side, a first leg extending from the first side of the base, a second leg extending from the first side of the base, and a third leg extending from the first side of the base. A first pin can extend from an end of the first leg opposite the base. A second pin can extend from an end of the second leg opposite the base.

According to yet another aspect, a reciprocating engine is described and can be implemented or provided. The reciprocating engine can comprise: a cylinder in an engine block of the reciprocating engine; an intake actuation assembly to introduce fuel and/or air into the cylinder for combustion, the intake actuation assembly including an intake lifter, an intake pushrod, an intake rocker arm, an intake valve bridge, and at least one intake valve; an exhaust actuation assembly to allow exhaust to exit the cylinder, the exhaust actuation assembly including an exhaust lifter, an exhaust pushrod, an exhaust rocker arm, an exhaust valve bridge, and at least one exhaust valve; and a hydrogen actuation assembly to introduce hydrogen directly into the cylinder, the hydrogen actuation assembly including a hydrogen lifter, a hydrogen pushrod, a hydrogen rocker arm, a hydrogen valve bridge, and a gas admission valve. The intake rocker arm, the exhaust rocker arm, and the hydrogen rocker arm can be individually rotatable about a common shaft to open and close the at least one intake valve, the at least one exhaust valve, and the gas admission valve, respectively. One of the intake rocker arm and the exhaust rocker arm can be on the common shaft between the hydrogen rocker arm and the other of the intake rocker arm and the exhaust rocker arm.

DETAILED DESCRIPTION

Embodiments of the disclosed subject matter relate to valves for reciprocating engines, and more particularly to a valve bridge to operatively interface with a rocker arm and a valve, and systems, assemblies, and methods thereof. The valve may be gas admission valve (GAV), for instance, to introduce hydrogen into a cylinder of a reciprocating engine.

Figure 1:
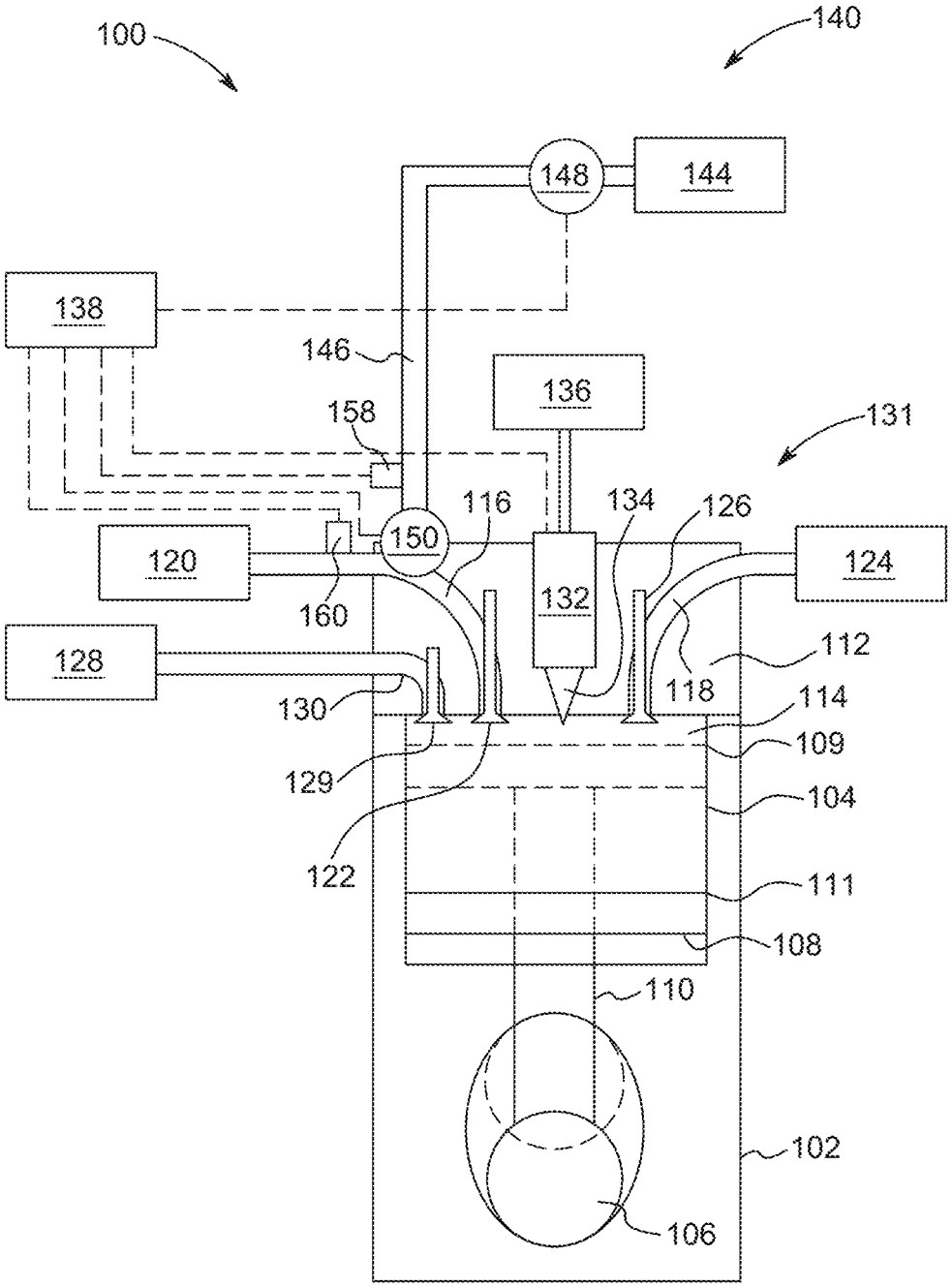
FIG. 1 is a block diagram of an exemplary system according to one or more embodiments of the disclosed subject matter.

FIG. 1 shows a schematic representation of an exemplary reciprocating engine 100 according to one or more embodiments of the disclosed subject matter. Optionally, the engine 100 may be an international combustion engine. The engine 100 may operate via a gaseous fuel such as, for example, natural gas, propane, methane, hydrogen, and the like, which may be optionally mixed with air. Additionally or alternatively, the engine 100 may operate via a liquid fuel that may be, for example, gasoline or diesel. Thus, the engine 100 may be a multi-fuel internal combustion engine. As noted above, the engine 100 may be operate using hydrogen ($H_2$), for instance, 100% hydrogen, as fuel on a full-time or part-time basis. Thus, the engine 100 may be referred to or characterized as a hydrogen internal combustion engine (hydrogen ICE). The engine 100 may be used in machines used for the purpose of construction, mining, agriculture, power generation and other known industries.

The engine 100 may include a cylinder block 102 for defining one or more cylinders 104 therein. The cylinder block 102 may be referred to or characterized as an engine block. In the case of multiple cylinders, the cylinders 104 may be arranged in various configurations within the cylinder block 102 such as, for example, inline, rotary, v-type, etc. For illustration purposes, only one cylinder 104 is shown in FIG. 1.

The cylinder block 102 may further include a crankshaft 106 that may be rotatably supported in the cylinder block 102. A piston 108 may be slidably disposed within the cylinder 104 and pivotally coupled with one end of a connecting rod 110. Another end of the connecting rod 110 may be coupled to the crankshaft 106. Thus the piston 108 and the crankshaft 106 may be operatively coupled with each other via the connecting rod 110. The piston 108 may be movable between a top dead center (TDC) 109 and a bottom dead center (BDC) 111 within the cylinder 104 to define one stroke. The top dead center 109 may be defined as a maximum extent to which the piston 108 may travel during an upward stroke of the piston 108. The bottom dead center 111 may be defined as a maximum extent to which the piston 108 may travel during a downward stroke of the piston 108.

A cylinder head 112 may be disposed on a top surface of the cylinder 104 to enclose the cylinder 104. A combustion chamber 114 may be defined within the cylinder 104 between the cylinder head 112 and the top dead center 109 of the piston 108 during upward stroke thereof. The usage of the term 'fuel' hereinafter may be considered as either gaseous fuel and/or liquid fuel unless otherwise specifically termed as 'gaseous fuel' or 'liquid fuel.'

The cylinder head 112 can include at least one intake port 116 and at least one exhaust port 118 for each cylinder 104. Optionally, two intake ports 116 and two exhaust ports 118 can be provided for each cylinder 104. The intake port 116 may be in fluid communication with the cylinder 104 and a charge air system 120.

The charge air system 120 may be fluidly connected to the intake port 116 via an intake manifold. In the case of engine 100 with multiple cylinders 104, the intake manifold may be fluidly disposed between the charge air system 120 and the intake port 116 of each of the cylinders 104 to distribute air supply to each cylinder 104 substantially at same pressure. The charge air system 120 may include an air cleaner, and compressor and/or turbo charger for receiving air from ambient, pressurizing and filtering the air. The filtered air may be supplied to the cylinder 104 through the intake port 116 during a suction stroke of the piston 108. The suction stroke may be defined as a downward stroke of the piston 108 from the top dead center 109 to the bottom dead center 111.

The intake port 116 may be provided with an inlet valve 122 (which may also be referred to as an intake valve 122) that may selectively allow air to enter into the cylinder 104 upon actuation of the inlet valve 122. The inlet valve 122 may be actuated by an arrangement having a rocker arm and a camshaft, which is discussed in more detail below. In other embodiments, each cylinder 104 may include two or more intake ports 116 and corresponding two or more inlet valves 122 to supply ambient air into the cylinder 104 during the suction stroke of the piston 108.

The exhaust port 118 may be in fluid communication with the cylinder 104 and an exhaust gas system 124. The exhaust gas system 124 may be fluidly connected to the exhaust port 118 via an exhaust manifold. In the case of engine 100 with multiple cylinders 104, the exhaust manifold may be fluidly disposed between the exhaust gas system 124 and the exhaust port 118 of each of the cylinders 104 to exit exhaust gas from each cylinder 104 to atmosphere. The exhaust gas system 124 may include, among other components, a silencer to reduce noise that may be generated by the engine 100. In other embodiments, the exhaust gas system 124 may include a turbine of a turbo charger, an exhaust gas recirculation system, and/or an exhaust gas aftertreatment system.

The exhaust port 118 may be provided with an exhaust valve 126 that may selectively exit the exhaust to atmosphere via the exhaust gas system 124 upon actuation of the exhaust valve 126. The exhaust valve 126 may be actuated by the arrangement having the rocker arm and the camshaft, which is discussed in more detail below. In other embodiments, each cylinder 104 may include two or more exhaust ports and corresponding exhaust valves 126 to exit the exhaust gas from the cylinder 104 (via the exhaust gas system 124) during an exhaust stroke of the piston 108. The exhaust stroke may be defined as an upward stroke of the piston 108 from the bottom dead center 111 to the top dead center 109.

The cylinder 104 of the engine 100 may be further fluidly communicated with a hydrogen supply system 128 via a hydrogen port 130 that can be provided in the cylinder head 112. A valve 129, which may be referred to as a gas admission valve (GAV), may be disposed in the hydrogen port 130 to selectively allow or restrict flow of hydrogen into the cylinder 104. The valve 129 may be actuated by the arrangement having the rocker arm and the camshaft, which is discussed in more detail below. The hydrogen supply system 128 may include a reservoir or another repository to store and provide hydrogen to the hydrogen port 130. According to one or more embodiments, only one hydrogen port 130 and corresponding valve 129 may be provided or implemented per cylinder 104.

A fuel supply system 131 may be fluidly communicated with the cylinder 104 of the engine 100. The fuel supply system 131 can include a fuel injection system 132 that may be disposed on the cylinder head 112 to inject liquid fuel into the cylinder 104 via at least one fuel injector 134. The fuel injection system 132 may be further fluidly communicated with a liquid fuel supply system 136 to receive liquid fuel therethrough. In an embodiment, the liquid fuel supply system 136 may include a first liquid fuel tank to store, for example, heavy fuel oil (FIFO), diesel, gasoline, and a second liquid fuel tank to store, for example, diesel or gasoline. In another embodiment, the fuel injection system 132 may include one fuel injector to inject liquid fuel into the cylinder 104 in a liquid fuel mode of the engine 100 and an ignition fuel injector to inject, for example a small amount of diesel as ignition energy in a gaseous fuel mode of the engine 100. In yet another embodiment, the fuel injection system 132 may include one fuel injector to inject liquid fuel in the liquid fuel mode and pilot amount of liquid fuel in the gaseous fuel mode. In various embodiments, an ignition device such as spark plug may be disposed in the cylinder head 112 in communication with the cylinder 104 for initiating combustion process during the gaseous fuel mode. Alternatively, the combustion may be via compression only. The fuel injection system 132 may be electrically communicated with a controller 138 to selectively inject liquid fuel into the cylinder 104.

In addition to supplying liquid fuel or in alternative to supplying liquid fuel, the fuel supply system 131 can include a gaseous fuel supply system 140. The gaseous fuel supply system 140 can include a gaseous fuel reservoir 144 to store gaseous fuel therein, or a fuel supply connected to a gaseous supply grid. The gaseous fuel reservoir 144 may be fluidly communicated with the intake port 116 via a gaseous fuel line 146. In an embodiment, the gaseous fuel line attached to the engine 100 may be a gas pipe. A shut-off valve 148 valve may be disposed in the gaseous fuel line 146 and electrically communicated with the controller 138. The shut-off valve 148 may selectively allow or restrict a flow of gaseous fuel from the gaseous fuel reservoir 144 to the gaseous fuel line 146. Additionally, a venting valve may be disposed in the gaseous fuel line 146 and electrically communicated with the controller 138 to release remaining fuel in the gaseous fuel line 146 upon receipt of a control signal from the controller 138. Apart from the shut-off valve 148 and the venting valve, it may be contemplated that different control valves may be disposed between the gaseous fuel reservoir 144 and the gaseous fuel line 146 to control a flow of gaseous fuel from the gaseous fuel reservoir 144. The control valves may be electrically actuated by the controller 138.

The gaseous fuel supply system 140 may further include an admission valve 150 that may be disposed between the gaseous fuel line 146 and the intake port 116 of the engine 100. Further, the admission valve 150 may be in communication with the gaseous fuel reservoir 144 via the gaseous fuel line 146. The admission valve 150 may be a solenoid operated valve and may be electrically communicated with the controller 138. The admission valve 150 may selectively allow or restrict a flow of gaseous fuel from the gaseous fuel line 146 to the intake port 116. Further, the admission valve 150 may be further configured to regulate a flow of gaseous fuel from the gaseous fuel line 146 to the intake port 116 based on a signal from the controller 138. Gaseous fuel may mix with air received from the charge air system 120 within the intake port 116.

The controller 138 may be in communication with a first sensor 158 disposed in the gaseous fuel line 146 upstream of the admission valve 150. The first sensor 158 may be a pressure sensor. The first sensor 158 may be disposed in the gaseous fuel line 146 to communicate the pressure of the gaseous fuel in the gaseous fuel line 146 to the controller 138. Further, the controller 138 may be in communication with a second sensor 160 that is fluidly disposed between the charge air system 120 and the intake port 116 of the engine 100. The second sensor 160 may be a pressure sensor configured to communicate the pressure of the mixture of air and gaseous fuel in the intake port 116 to the controller 138. In another embodiment, the sensor 160 may be fluidly disposed in the charge air system 120 configured to communicate the pressure of the air in the charge air system 120 to the controller 138. Thus, the first sensor 158 and the second sensor 160 may enable the controller 138 to monitor a pressure difference between the gaseous fuel line 146 and the intake port 116.

In an embodiment, the controller 138 may include a central processing unit, a memory and input/output ports that facilitates communication with the various components including, but not limited to, the admission valve 150, the shut-off valve 148, the fuel injection system 132, and the first and second sensors 158, 160. The controller 138 may also include input/output ports that facilitate the electric power supply for the various actuators. Referring to FIG. 1, communication of the controller 138 with the various components is represented with a dotted line.

Turning now to FIGS. 2-5, these figures show a portion of an engine 200 according to one or more embodiments of the disclosed subject matter. The engine 200 can be represented by or representative of the engine 100 of FIG. 1 or vice versa.

In FIGS. 2-5, the engine 200 can include a cylinder block 202 (which may also be referred to as an engine block 202) in the cylinder block 202, a cylinder 204, and a cylinder head 212. The cylinder block 202 may include multiple cylinders 204. The engine 200 may also include a camshaft 213 (see FIG. 3 and FIG. 5).

A plurality of ports can be defined within the cylinder head 212 and leading to the cylinder 204. For instance, the engine 200 can have a hydrogen port 250, at least one intake or inlet port 216, and at least one exhaust port. The engine 200 in FIGS. 2-5 can have, for example, two intake ports 216 and two exhaust ports. The hydrogen port 250 and each of the intake port 216 and the exhaust port can lead directly to the cylinder 204.

Figure 4:
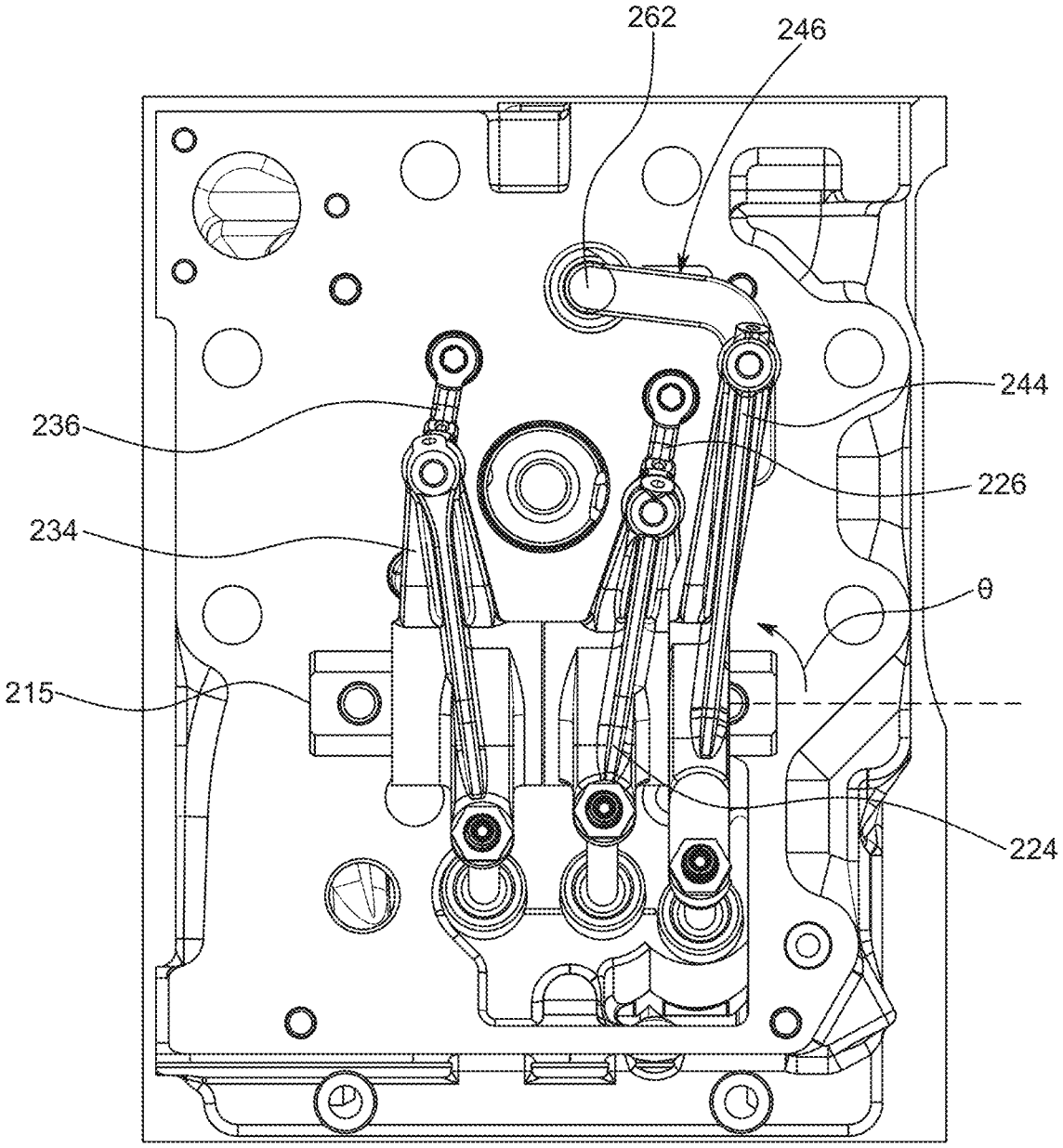
FIG. 4 is a top plan view of a portion a portion of the engine of FIG. 2.

In a top view of the engine 200, for instance, a top plan view, the hydrogen port 250 can be farther from the shaft 215 than a first longitudinal axis associated with each at least one intake valve and a second longitudinal axis associated with each at least one exhaust valve, where the first and second longitudinal axis can be perpendicular to a direction parallel to the shaft 215, such as shown in FIG. 4. Put another way, in the top view of the engine 200 (e.g., top plan view), the hydrogen port 250 can be farther from the shaft 215 than each of the intake valve bridge 226 and the exhaust valve bridge 236. Further, the hydrogen port 250 can be between the intake valve bridge 226 and the exhaust valve bridge 236 in the direction parallel to the shaft 215, such as shown in FIG. 4.

In some respects, the engine 200 may be an engine with the intake port(s) 216 and the exhaust port(s) and with the hydrogen port 250 added on. In this regard, the placement of the hydrogen port 250 may be relatively far from the shaft 215, since it may not be possible to implement the hydrogen port 250 (and hydrogen manifold) at another position (e.g., beside an intake port 216 or beside an exhaust port, in the direction parallel to the shaft 215) because engine architecture may not allow such alternate placement, for instance, because of additional cylinders 204 arranged side-by-side in that direction (i.e., in the direction parallel to the shaft 215).

A plurality of actuation assemblies may be associated with each cylinder 204. In particular, FIGS. 2-5 show an intake or inlet actuation assembly 220, an exhaust actuation assembly 230, and a gas (e.g., hydrogen) actuation assembly 240. The intake actuation assembly 220, the exhaust actuation assembly 230, and the hydrogen actuation assembly 240, collectively, can be referred to as an actuation system. Further, the gas actuation assembly 240 may be referred to herein as a hydrogen actuation assembly 240 or simply an actuation assembly. In that the engine 200 can have multiple cylinders 204, the engine 200 can have multiple sets of the intake actuation assembly 220, the exhaust actuation assembly 230, and the hydrogen actuation assembly 240, one set per cylinder 204.

Intake actuation assembly 220 can be to introduce fuel and/or air into the cylinder 204 for combustion. The intake actuation assembly 220 can include an intake lifter 222, an intake pushrod 223, an intake rocker arm 224, an intake valve bridge 226, and at least one intake valve. The engine 200 of FIGS. 2-5 can have two intake valves per cylinder 204, for instance. The intake actuation assembly 220 may also include an intake follower 221.

Exhaust actuation assembly 230 can be to allow exhaust to exit the cylinder 204. The exhaust actuation assembly 230 can include an exhaust lifter 232, an exhaust pushrod 233, an exhaust rocker arm 234, an exhaust valve bridge 236, and at least one exhaust valve, FIGS. 2-5 show two exhaust valves per cylinder 204, for instance. The exhaust actuation assembly 230 may also include an exhaust follower 231.

Hydrogen actuation assembly 240 can be to introduce hydrogen into the cylinder 204. Such introduction of hydrogen can be directly into the cylinder 204. The hydrogen actuation assembly 240 can include a hydrogen lifter 242, a hydrogen pushrod 243, a hydrogen rocker arm 244, a hydrogen valve bridge 246, and a hydrogen valve 248. The hydrogen valve 248 may be the only actuation valve by which to introduce hydrogen into the cylinder 204. Further, the hydrogen valve 248 may be referred to or characterized as a gas admission valve (GAN). The hydrogen actuation assembly 240 may also include a hydrogen follower 241.

The intake rocker arm 224, the exhaust rocker arm 234, and the hydrogen rocker arm 244 may be rotatable about shaft 215. The shaft 215 may be referred to or characterized as a common shaft. Here, the intake rocker arm 224, the exhaust rocker arm 234, and the hydrogen rocker arm 244 may be individually rotatable about the shaft 215, for instance, according to the specific timings associated with each actuation assembly, as set by the individual cam lobes 214 of the camshaft 213 acting (as the camshaft 213 rotates) on the intake follower 221, the exhaust follower 231, and the hydrogen follower 241. According to one or more embodiments, the intake rocker arm 224 can be between the exhaust rocker arm 234 and the hydrogen rocker arm 244. Thus, the hydrogen rocker arm 244 can be at one end or side of the set of three rocker arms, per cylinder 204.

The followers act on their respective lifters, pushrods, rocker arms, and valve bridges to actuate correspond ones of the intake valve(s), the exhaust valve(s), and the hydrogen valve 248. Here, actuation of the intake valve(s), the exhaust valve(s), and the hydrogen valve 248 can include or mean opening and/or closing of the valves. Thus, the intake valve can open and close a corresponding intake port 216, the exhaust valve can open and close a corresponding exhaust port, and the hydrogen valve 248 can open and close the hydrogen port 250. Thus, the hydrogen port 250 can lead directly to the cylinder 204, i.e., an opening of the hydrogen port 250 opens directly into the cylinder 204, where the hydrogen valve 248 can open and close to prevent or allow passage of hydrogen into the cylinder 204. Accordingly, according to embodiments of the disclosed subject matter, each cylinder 204 can have a dedicated hydrogen port 250 and corresponding dedicated hydrogen valve 248 for the direct introduction of hydrogen into the cylinder 204.

Figure 2:
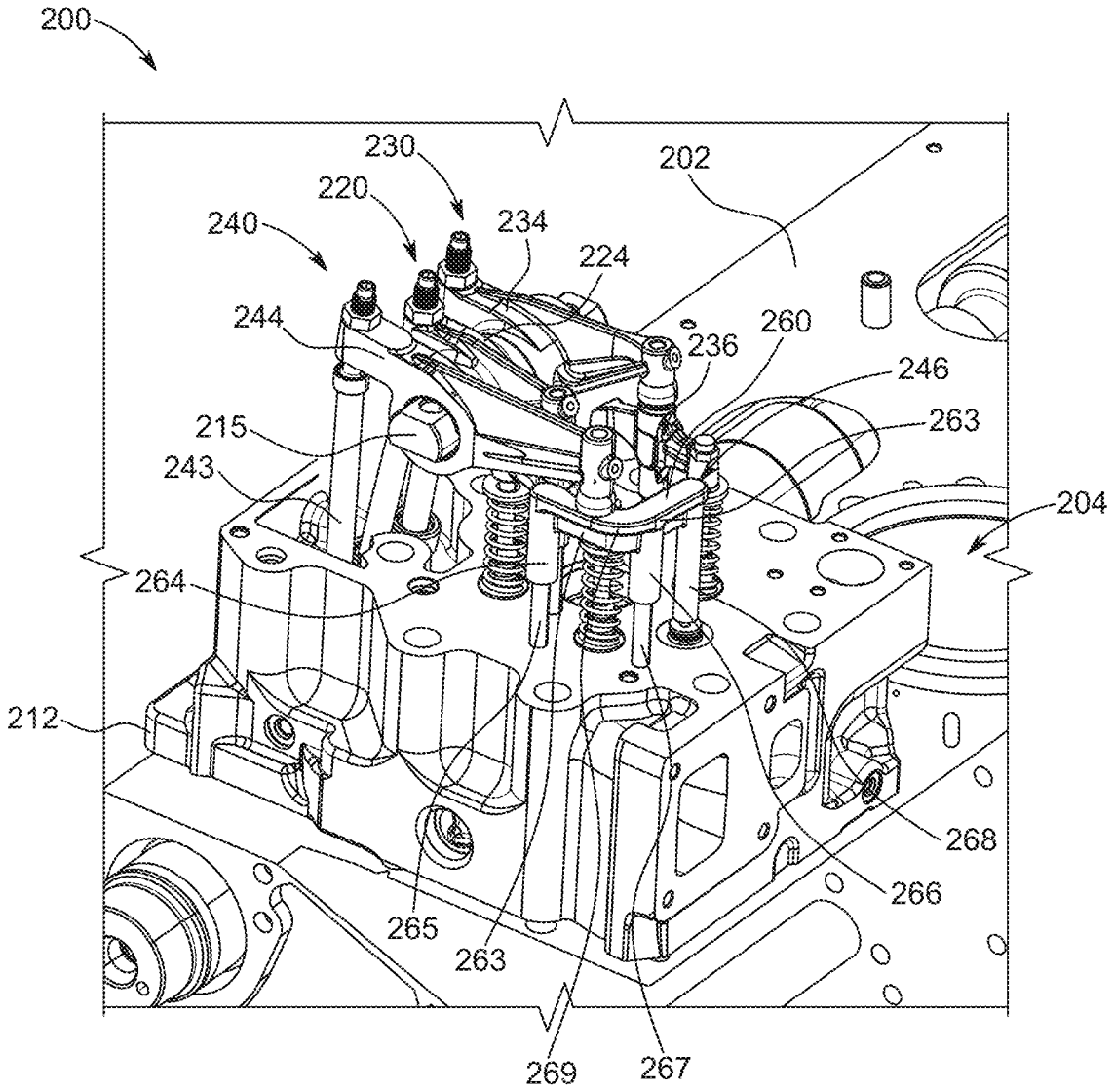
FIG. 2 is a perspective view of a portion of an engine according to one or more embodiments of the disclosed subject matter.
Figure 3:
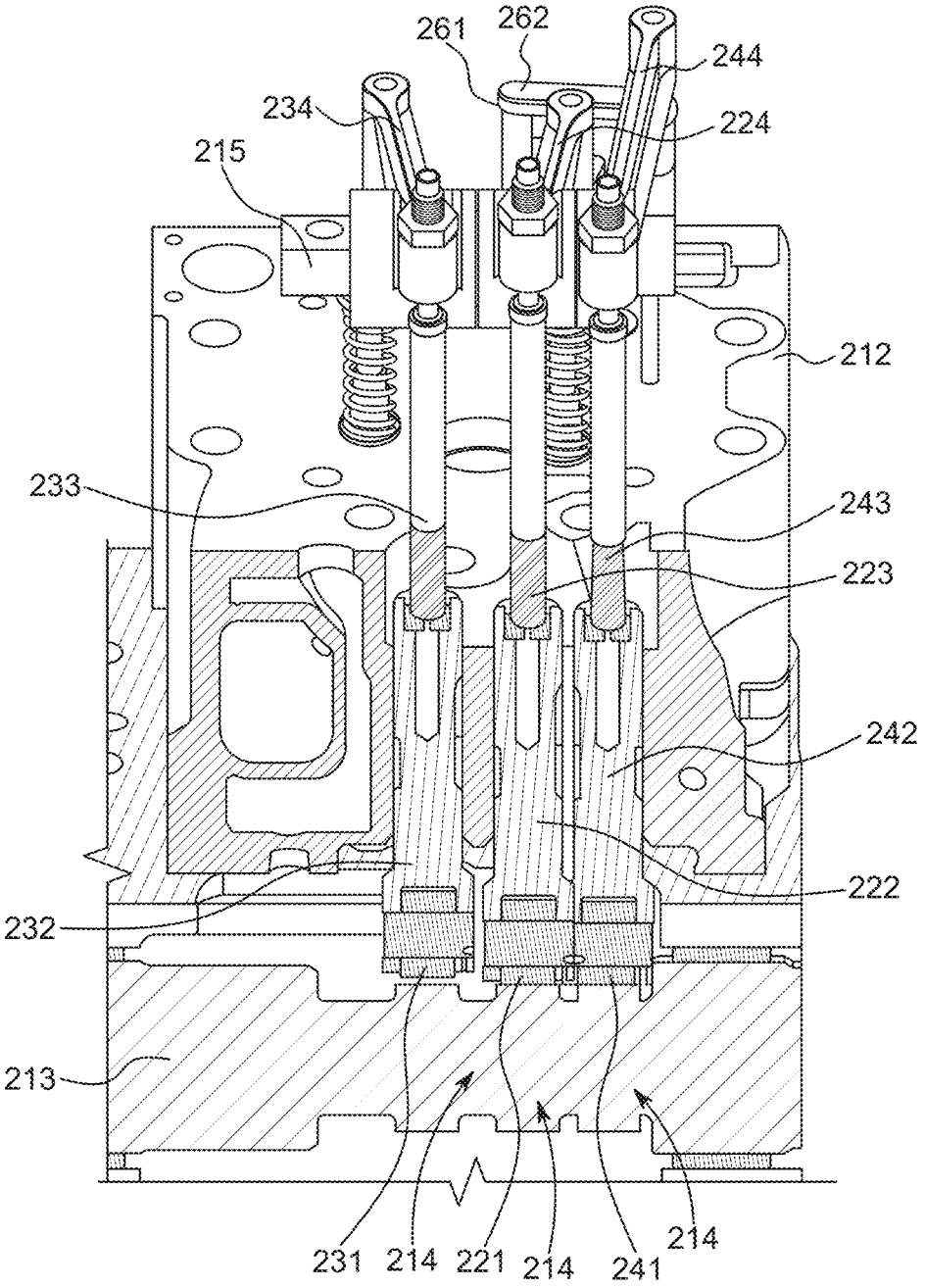
FIG. 3 is a sectional view of a portion of the engine of FIG. 2.

The body of the hydrogen rocker arm 244 around the shaft 215 may touch or abut the body of the adjacent rocker arm (the intake rocker arm 24 in FIGS. 2-5). However, in a top view of the engine 200 (e.g., a top plan view), the hydrogen rocker arm 244 can extend from the shall 215 at an angle θ, such as shown in FIG. 3 and FIG. 4. The angle θ may be a non-perpendicular angle, for instance, away from the intake rocker arm 224 and the exhaust rocker arm 234. Optionally, the angle θ can be the same of different from respective angles at which the intake rocker arm 224 and the exhaust rocker arm 234 extend from the shaft 215 (in the top view(s) of the engine 200).

The hydrogen rocker arm 244 can extend from the shaft 215 more than each of the intake rocker arm 224 and the exhaust rocker arm 234 extend from the shaft 215. That is, the hydrogen rocker arm 244 may be longer than each of the intake rocker arm 224 and the exhaust rocker arm 234. The length and angle for the hydrogen rocker arm 244 may be such that the end of the hydrogen rocker arm 244 opposite the shaft 215 does not overlap with any inlet ports 216 or any exhaust ports.

Optionally, a thickness of at least the body or base of the hydrogen rocker arm 244 may be less than a thickness of at least the body or base of the intake rocker arm 224 and/or a thickness of the body or base of the exhaust rocker arm 234. FIG. 3 and FIG. 4, for instance, show the base and a portion of the arm of the hydrogen rocker arm 244 being less thick than the base and a portion of the arm of the intake rocker arm 224, as well as being less thick than the base and a portion of the arm of the exhaust rocker arm 234. The angle θ at which the hydrogen rocker arm 244 extends from the shaft 215 may be set based on the thickness of the base of the hydrogen rocker 244. Optionally, the thickness of the base of the hydrogen rocker 244 may be based on available space at that particular end of the shaft 215.

The hydrogen valve bridge 246 can include a base or body 260 and a plurality of legs, including a first leg 264, a second leg 266, and a third leg 268. The base 260 can define or have a first side 261 and a second side 262 opposite the first side 261. The first side 261 may be referred to or characterized as an underside or bottom side, whereas the second side 262 may be referred to or characterized as a topside or upper side.

Each of the first leg 264, the second leg 266, and the third leg 268 can extend from the base 260. More specifically, each of the first leg 264, the second leg 266, and the third leg 268 can extend from the first side 261 of the base 260. Optionally, a brace 263 can extend between the first leg 264 and the second leg 266 and between the second leg 266 and the third leg 268. Each brace 263 may be considered to be part of the base 260. Otherwise, the braces 263 can be considered to extend from the first side 261 of the base 260. Optionally, the base 260, the first leg 264, the second leg 266, the third leg 268, and the optional braces 263 can be formed in one piece.

Whether with or without the braces 263, the first leg 264, the second leg 266, and the third leg 268 can be spaced separately from each other, along a length of the base 260. In this regard, the first leg 264 can be at a first end or end portion of the base 260, the third leg 268 can be at a second end or end portion of the base 260 opposite the first end/end portion, and the second leg 266 can be between the first leg 264 and the third leg 268.

The hydrogen valve bridge 246 can be bent or curved in a top plan view thereof. Specifically, the base 260 can be bent or curved so as to define or have a curved or bent portion 269. The bent portion 269 can define a corner of the base 260 of the hydrogen valve bridge 246. According to one or more embodiments, the base 260 can be L-shaped in a top plan view of the hydrogen valve bridge 246, for instance, at an angle of ninety degrees plus or minus five degrees. The first leg 264 may be on one side of the bent portion 269, whereas the second leg 266 and the third leg 268 can be on the other side of the bent portion 269. The portion of the base 260 on the one side of the bent portion 269 may be referred to as a first portion of the base or body 260, and the portion of the base 260 on the other side of the bent portion 269 may be referred to as a second portion of the base or body 260.

At least the first leg 264 and the second leg 266, each of which can be cylindrical in shape, can extend in in same direction from the first side 261 off the base 260. Thus, the first leg 264 and the second leg 266 may extend in parallel with each other. The third leg 268, which may be cylindrical in shape, may also extend in the same direction as the first leg 264 and the second leg 266. Optionally, the first leg 264 and the second leg 266 can be the same length. Thus, the first leg 264 and the second leg 266 can extend from the base 260 by a same amount. The third leg 268 may be longer than the first leg 264 and the second leg 266 and can thus extend from the base 260 more than the first leg 264 and the second leg 266.

The first leg 264 can have a pin 265 extending from an end of the first leg 264 opposite the end of the first leg 264 that meets or interfaces with the base 260. The second leg 266 also can have a pin 267 extending from an end of the second leg 266 opposite the end of the second leg 266 that meets or interfaces with the base 260. The pin 265 can extend in a same direction as the first leg 264. Likewise, the pin 267 can extend in a same direction as the second leg 266. Thus, the pin 265 and the pin 267 can extend in the same direction. The first leg 264 including the pin 265 can have a same length as the second leg 266 including the pin 267. Generally, the pin 265 and the pin 267 can have a cross sectional dimension less than that of the first leg 264 and the second leg 266, respectively.

INDUSTRIAL APPLICABILITY

As noted above, embodiments of the disclosed subject matter relate to valves for reciprocating engines, and more particularly to a valve bridge to operatively interface with a rocker arm and a valve, and systems, assemblies, and methods thereof. The valve may be gas admission valve (GANT), for instance, to introduce hydrogen into a cylinder of a reciprocating engine.

In a top view of the engine 200, for instance, a top plan view, the hydrogen port 250 can be farther from the shaft 215 than a first longitudinal axis associated with each at least one intake valve and a second longitudinal axis associated with each at least one exhaust valve, where the first and second longitudinal axis can be perpendicular to a direction parallel to the shaft 215, such as shown in FIG. 4. Put another way, in the top view of the engine 200 (e.g., top plan view), the hydrogen port 250 can be farther from the shaft 215 than each of the intake valve bridge 226 and the exhaust valve bridge 236. Further, the hydrogen port 250 can be between the intake valve bridge 226 and the exhaust valve bridge 236 in the direction parallel to the shaft 215, such as shown in FIG. 4.

In some respects, the engine 200 may be an engine with the intake port(s) 216 and the exhaust port(s) and with the hydrogen port 250 added on. In this regard, the placement of the hydrogen port 250 may be relatively far from the shaft 215, since it may not be possible to implement the hydrogen port 250 (and hydrogen manifold) at another position (e.g., beside an intake port 216 or beside an exhaust port in the direction parallel to the shaft 215) because engine architecture may not allow such alternate placement, for instance, because of additional cylinders 204 arranged side-by-side in that direction (i.e., in the direction parallel to the shaft 215).

A hydrogen actuation assembly, such as hydrogen actuation assembly 240, can controllably introduce hydrogen into the cylinder 204. Such introduction of hydrogen can be directly into the cylinder 204. The hydrogen actuation assembly 240 can include the hydrogen lifter 242, the hydrogen pushrod 243, the hydrogen rocker arm 244, the hydrogen valve bridge 246, and the hydrogen valve 248. The hydrogen valve 248 may be the only actuation valve by which to introduce hydrogen into the cylinder 204. The hydrogen actuation assembly 240 may also include the hydrogen follower 241.

The hydrogen valve bridge 246 can include the base or body 260 and the first leg 264, the second leg 266, and the third leg 268. Each of the first leg 264, the second leg 266, and the third leg 268 can extend from the base 260, particularly from the first side 261 of the base 260.

The first leg 264, the second leg 266, and the third leg 268 can be spaced separately from each other, along a length of the base 260. In this regard, the first leg 264 can be at a first end or end portion of the base 260, the third leg 268 can be at a second end or end portion of the base 260 opposite the first end/end portion, and the second leg 266 can be between the first leg 264 and the third leg 268.

The hydrogen valve bridge 246 can be bent or curved in a top plan view thereof so as to define or have the curved or bent portion 269. The bent portion 269 can define a corner of the base 260 of the hydrogen valve bridge 246. According to one or more embodiments, the base 260 can be L-shaped in the top plan view of the hydrogen valve bridge 246, for instance, at an angle of ninety degrees plus or minus five degrees. Here, the first leg 264 may be on one side of the bent portion 269, whereas the second leg 266 and the third leg 268 can be on the other side of the bent portion 269.

Figure 5:
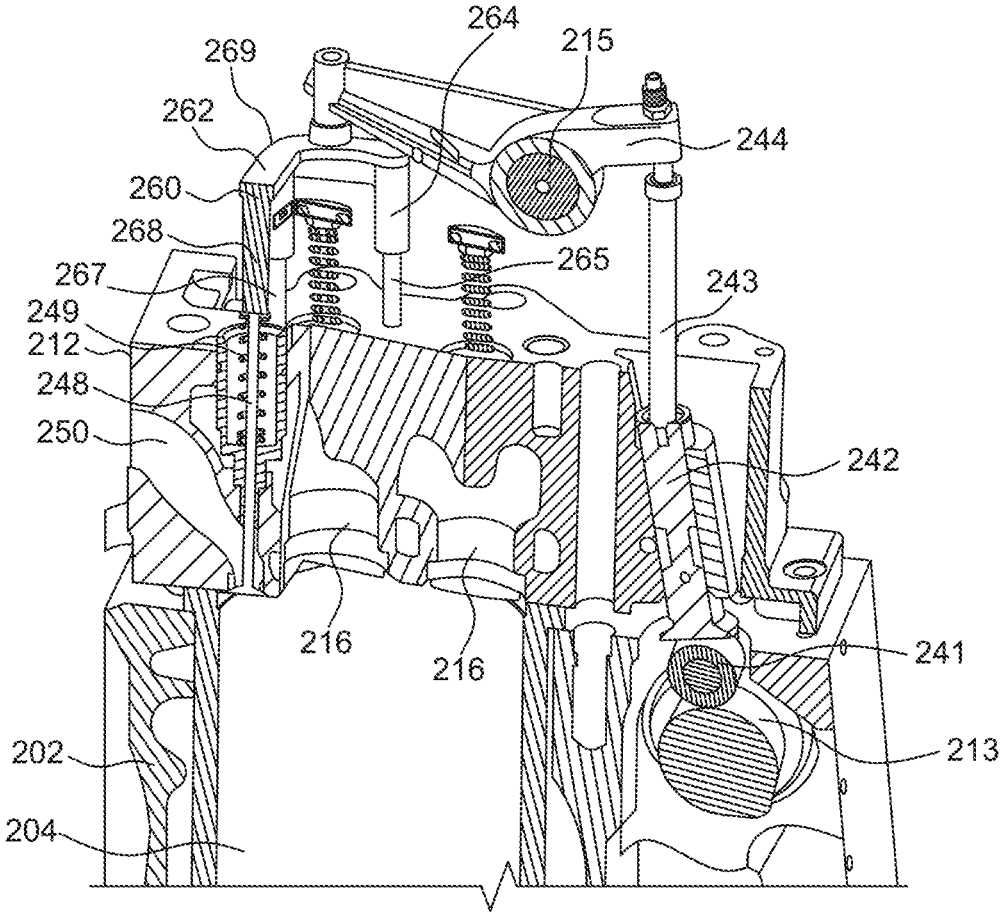
FIG. 5 is a side sectional view of a portion of the engine of FIG. 2.

The first leg 264 can have the pin 265 extending from an end of the first leg 264 opposite the end of the first leg 264 that meets or interfaces with the base 260, and the second leg 266 can have the pin 267 extending from an end of the second leg 266 opposite the end of the second leg 266 that meets or interfaces with the base 260, Further, the pin 265 and the pin 267 can contact the cylinder head 112, such as shown in FIG. 2 and FIG. 5. Optionally, the pin 265 and the pin 267 can be removably fixed to the cylinder head 112, for instance, via respective recesses or the like, so the hydrogen valve bridge 246 can translate on the pins 265, 267 under control of the hydrogen rocker arm 244 and a valve spring 249 of the hydrogen valve 248.

The hydrogen valve bridge 246 can be operatively coupled between the hydrogen rocker arm 244 and the hydrogen valve 248. More specifically, an end of the hydrogen rocker arm 244 opposite the hydrogen pushrod 243 may interface with the second side 262 of the base 260 of the hydrogen rocker arm 244 and the third leg 268 of the hydrogen valve bridge 246 can interface with the hydrogen valve 248. Optionally, the end of the hydrogen rocker arm 244 may have a button or the like that directly contacts the second side 262 of the base 260, such as shown in FIG. 5. Here, the interface between the end of the hydrogen rocker arm 244 and hydrogen valve bridge 246 can be at a portion of the base 260 between where the first leg 264 and the second leg 266 respectively extend from the base 260, for instance, between the bent portion 269 and where the first leg 264 extends from the base 260.

The third leg 268 of the hydrogen valve bridge 246 can interface with the hydrogen valve 248. In particular, the end of the third leg 268 opposite the base 260 can interface (e.g., directly connected to, etc.) with a valve rod of the hydrogen valve 248.

Generally, the hydrogen valve bridge 246 can convert rotational movement of the hydrogen rocker arm 244 to linear movement to move linearly the hydrogen valve 248. Here, movement of the end of the hydrogen rocker arm 244 that contacts the hydrogen valve bridge 246 can cause the hydrogen valve bridge 246 to translate about the pins 265, 267, thereby causing the third leg 268 of the hydrogen valve bridge 246 to move linearly upward and down along with the hydrogen valve 248 to close and open the hydrogen valve 248. When the hydrogen rocker arm 244 is not pushing down on the hydrogen valve bridge 246, the hydrogen valve 248 can be closed, by the force of the valve spring 249 of the hydrogen valve 248, for instance. Optionally, a gap may exist between the end of the hydrogen rocker arm 244 and the hydrogen valve bridge 246 when the hydrogen valve 248 is closed, for instance, so that no force motion can be transmitted to the hydrogen valve 248 when the hydrogen valve 248 is closed.

It must be noted that, as used in the specification and the appended claims, the singular forms "a," "an," and "the" include plural referents unless the context clearly dictates otherwise. That is, unless clearly specified otherwise, as used herein the words "a" and "an" and the like carry, the meaning of "one or more." The use of the term "at least one" followed by a list of one or more items (for example, "at least one of A and B" or one or more of A and B") is to be construed to mean one item selected from the listed items (A or B) or any combination of two or more of the listed items (A and B; A, A and B; A, B and B), unless otherwise indicated herein or clearly contradicted by context. Similarly, as used herein, the word "or" refers to any possible permutation of a set of items. For example, the phrase "A, B, or C" refers to at least one of A, B, C, or any combination thereof, such as any of: A; B; C; A and B; A and C; B and C; B, and C; or multiple of any item such as A and A; B, B, and C; A, A, B, C, and C; etc.

Additionally, it is to be understood that terms such as "left," "right," "top," "bottom," "front," "rear," "side," "height," "length," "width," "upper," "lower," "interior," "exterior," "inner," "outer," and the like that may be used herein, merely describe points of reference and do not necessarily limit embodiments of the disclosed subject matter to any particular orientation or configuration. Furthermore, terms such as "first," "second," "third," etc., merely identify one of a number of portions, components, points of reference, operations and/or functions as described herein, and likewise do not necessarily limit embodiments of the disclosed subject matter to any particular configuration or orientation.

While aspects of the present disclosure have been particularly shown and described with reference to the embodiments above, it will be understood by those skilled in the art that various additional embodiments may be contemplated by the modification of the disclosed machines, assemblies, systems, and methods without departing from the spirit and scope of what is disclosed. Such embodiments should be understood to fall within the scope of the present disclosure as determined based upon the claims and any equivalents thereof.

The invention claimed is:

1. A reciprocating engine comprising:

a cylinder in an engine block of the reciprocating engine;

an intake actuation assembly to introduce fuel and/or air into the cylinder for combustion, the intake actuation assembly including an intake lifter, an intake pushrod, an intake rocker arm, an intake valve bridge, and at least one intake valve;

an exhaust actuation assembly to allow exhaust to exit the cylinder, the exhaust actuation assembly including an exhaust lifter, an exhaust pushrod, an exhaust rocker arm, an exhaust valve bridge, and at least one exhaust valve; and a hydrogen actuation assembly to introduce hydrogen directly into the cylinder, the hydrogen actuation assembly including a hydrogen lifter, a hydrogen pushrod, a hydrogen rocker arm, a hydrogen valve bridge, and a gas admission valve, wherein the intake rocker arm, the exhaust rocker arm, and the hydrogen rocker arm are individually rotatable about a common shaft to open and close the at least one intake valve, the at least one exhaust valve, and the gas admission valve, respectively, and wherein one of the intake rocker arm and the exhaust rocker arm is on the common shaft between the hydrogen rocker arm and the other of the intake rocker arm and the exhaust rocker arm.

2. The reciprocating engine according to claim 1, wherein in a top plan view of the reciprocating engine, the hydrogen rocker arm extends from the common shaft at a non-perpendicular angle.

3. The reciprocating engine according to claim 1, wherein the hydrogen rocker arm is longer than each of the intake rocker arm and the exhaust rocker arm.

4. The reciprocating engine according to claim 1, further comprising a hydrogen port leading directly to the cylinder to introduce the hydrogen directly into the cylinder via the gas admission valve, wherein in a top plan view of the reciprocating engine, the hydrogen port is farther from the common shaft than a first longitudinal axis intersecting with the at least one intake valve and a second longitudinal axis intersecting with the at least one exhaust valve, the first and second longitudinal axis being perpendicular to a direction parallel to the common shaft, and wherein the gas admission valve is between the intake valve bridge and the exhaust valve bridge in the direction parallel to the common shaft.

5. The reciprocating engine according to claim 4, wherein the hydrogen port is the only port to directly supply hydrogen to the cylinder.

6. The reciprocating engine according to claim 1, wherein the reciprocating engine includes plural sets of the cylinder, the intake actuation assembly, the exhaust actuation assembly, and the hydrogen actuation assembly.

7. The reciprocating engine according to claim 1, wherein the hydrogen valve bridge is operatively coupled between the hydrogen rocker arm and the gas admission valve, and wherein the hydrogen valve bridge is configured to convert rotational movement of the hydrogen rocker arm to linear movement to move linearly the gas admission valve.

8. The reciprocating engine according to claim 1, wherein the hydrogen valve bridge includes:

a base, a first leg extending from the base in a first direction, a second leg extending from the base in the first direction, and a third leg extending from the base in the first direction, wherein a first pin extends in the first direction from an end of the first leg opposite the base and contacts a cylinder head of the engine block, wherein a second pin extends in the first direction from an end of the second leg opposite the base and contacts the cylinder head of the engine block, and wherein the third leg interfaces with the gas admission valve.

9. The reciprocating engine according to claim 8, wherein the hydrogen rocker arm interfaces with the base of the hydrogen valve bridge at a portion of the base between where the first and second legs extend from the base.

10. An actuation assembly to introduce a gas into a cylinder of a reciprocating engine through a gas admission valve, the actuation assembly comprising:

a rocker arm rotatably coupleable to a common shaft; and a valve bridge to operatively interface with a first end of the rocker arm, wherein the valve bridge includes:

a base having a first side and a second side opposite the first side, the base further having a first end portion and a second end portion opposite the first end portion, a first leg extending from the first side of the base at the first end portion, a second leg extending from the first side of the base, a third leg extending from the first side of the base at the second end portion, and the base defining a non-linear path extending between the first end portion and the second end portion, and each of the first leg, the second leg and the third leg being disposed along the non-linear path, wherein the second leg is disposed between the first leg and the third leg along the non-linear path, wherein a first pin extends from an end of the first leg opposite the base and the valve bridge translates on the first pin, and wherein a second pin extends from an end of the second leg opposite the base and the valve bridge translates on the second pin.

11. The actuation assembly according to claim 10, wherein in a top plan view, the valve bridge is L-shaped.

12. The actuation assembly according to claim 10, wherein the first end of the rocker arm interfaces with the second side of the base of the valve bridge at a portion of the base along the non-linear path and between where the first and second legs extend from the first side of the base.

13. The actuation assembly according to claim 12, wherein in a top plan view, the valve bridge is L-shaped.

14. The actuation assembly according to claim 10, wherein the third leg is longer than each of the first leg and the second leg.

15. The actuation assembly according to claim 10, wherein in a top plan view, the base of the valve bridge has a bent portion defining a corner, wherein the base has a first portion and a second portion delineated by the bent portion, wherein the first leg extends from the first side of the base in the first portion of the base, and wherein the second leg and the third leg each extends from the first side of the base in the second portion of the base.

16. The actuation assembly according to claim 10, wherein the third leg extends a greater distance from the first side of the base than the first leg and the second leg.

17. The actuation assembly according to claim 10, wherein the gas admission valve is movable parallel to the third leg and the third leg is disposed along an axis of the gas admission valve.

18. A reciprocating engine comprising:

a cylinder in an engine block of the reciprocating engine;

an intake actuation assembly to introduce fuel and/or air into the cylinder, the intake actuation assembly including an intake lifter, an intake pushrod, an intake rocker arm, and at least one intake valve;

an exhaust actuation assembly to allow exhaust to exit the cylinder, the exhaust actuation assembly including an exhaust lifter, an exhaust pushrod, an exhaust rocker arm, and at least one exhaust valve; and a hydrogen actuation assembly to introduce hydrogen directly into the cylinder, the hydrogen actuation assembly including a hydrogen lifter, a hydrogen pushrod, a hydrogen rocker arm, a hydrogen valve bridge, and a gas admission valve, the hydrogen valve bridge including a base having a lower side and an upper side opposite the lower side, the base further having a first end portion and a second end portion opposite the first end portion, a first leg extending from the lower side of the base adjacent the first end portion, a second leg extending from the lower side of the base, a third leg extending from the lower side of the base adjacent the second end portion, and the base defining a non-linear path between the first end portion and the second end portion, and each of the first leg, the second leg and the third leg being disposed along the non-linear path, the second leg being disposed between the first leg and the third leg along the non-linear path, the third leg being parallel to an axis of the gas admission valve, a contact surface of the base being defined on the upper side of the base along the non-linear path between a first leg axis extending parallel to the first leg and a second leg axis extending parallel to the second leg, and the hydrogen rocker arm engaging the hydrogen valve bridge along the contact surface of the base, wherein the intake rocker arm, the exhaust rocker arm, and the hydrogen rocker arm are individually rotatable about a common shaft to open and close the at least one intake valve, the at least one exhaust valve, and the gas admission valve, respectively.

19. The reciprocating engine according to claim 18, wherein a first pin extends from an end of the first leg opposite the base and the hydrogen valve bridge translates on the first pin, and wherein a second pin extends from an end of the second leg opposite the base, and the hydrogen valve bridge translates on the second pin.

20. The reciprocating engine according to claim 18, wherein the third leg extends a greater distance from the lower side of the base than each of the first leg and the second leg.

* * * * *